US008344294B2

(12) United States Patent
Greiner et al.

(10) Patent No.: US 8,344,294 B2
(45) Date of Patent: Jan. 1, 2013

(54) METHOD AND COOKING APPLIANCE FOR COOKING ACCORDING TO THE C-VALUE

(75) Inventors: Michael Greiner, Landsberg (DE); Manfred Breunig, Schongau (DE)

(73) Assignee: Rational AG, Landsberg/Lech (DE)

( * ) Notice: Subject to any disclaimer, the term of this patent is extended or adjusted under 35 U.S.C. 154(b) by 1163 days.

(21) Appl. No.: 12/198,242

(22) Filed: Aug. 26, 2008

(65) Prior Publication Data

US 2009/0061070 A1 Mar. 5, 2009

(30) Foreign Application Priority Data

Aug. 27, 2007 (EP) ..... 07 016 734

(51) Int. Cl.
*H05B 1/02* (2006.01)

(52) U.S. Cl. ..... 219/492; 219/497; 99/325

(58) Field of Classification Search ..... 219/494, 219/492, 497, 496, 506, 412–414; 99/325–333; 426/246, 243
See application file for complete search history.

(56) References Cited

U.S. PATENT DOCUMENTS

| | | | | |
|---|---|---|---|---|
| 4,281,022 | A | 7/1981 | Buck | |
| 5,786,568 | A * | 7/1998 | McKinney | 219/400 |
| 6,299,921 | B1 | 10/2001 | Loffler et al. | |
| 6,753,027 | B1 | 6/2004 | Greiner et al. | |
| 2006/0112833 | A1 | 6/2006 | Blaschke | |
| 2007/0288192 | A1 | 12/2007 | Imgram et al. | |

FOREIGN PATENT DOCUMENTS

| | | |
|---|---|---|
| DE | 42 31 365 | 3/1994 |
| DE | 196 09 116 A | 9/1997 |
| DE | 199 45 021 | 4/2001 |
| DE | 10 2005 057 585 | 3/2007 |
| EP | 0 419 304 | 3/1991 |
| EP | 1 317 643 | 6/2003 |
| EP | 1 635 120 | 3/2006 |
| JP | 63 128 969 | 6/1988 |
| WO | WO-98/48679 | 1/1998 |
| WO | WO-01/58214 | 8/2001 |
| WO | WO-2004/062372 | 7/2004 |
| WO | WO-2006/045290 | 5/2006 |

OTHER PUBLICATIONS

European Search Report for Application No. EP07016734, dated Apr. 21, 2008.

* cited by examiner

*Primary Examiner* — Mark Paschall
(74) *Attorney, Agent, or Firm* — Marshall, Gerstein & Borun LLP

(57) ABSTRACT

A method for the cooking of a cooking product in a cooking appliance with a cooking chamber that comprises at least one heating device, a computer device, a memory device and at least one sensor device, is carried out, in dependence on a degree of cooking of a cooking product and/or of a cooking duration, in particular determined by the core temperature, the browning, the pH value and/or the cooking value, from values measured by the sensor device with consideration of the at least occasionally deposited values in the memory device via the computer device, wherein at least two steps separated from one another in time, comprising a pre-cooking step, which is interrupted when a determined intermediate value of the degree of cooking and/or of the duration of cooking, in particular a determined remaining time for reaching the cooking duration is reached, and a finishing cooking step, in particular a finishing step that is recalled at a later time point in order to end the cooking of the cooking product with consideration of the intermediate value.

49 Claims, 2 Drawing Sheets

METHOD AND COOKING APPLIANCE FOR COOKING ACCORDING TO THE C-VALUE

CROSS-REFERENCE TO RELATED APPLICATIONS

The priority benefit of EP 07016734.1, filed Aug. 27, 2007, is claimed and the entire contents thereof are hereby incorporated herein by reference.

FIELD OF THE INVENTION

The present invention concerns a method of cooking a cooking product in a cooking appliance with a cooking chamber, at least one heating device, a computer device, a memory device and at least one sensor device, the method being conducted by means of the computer device in dependence on a degree of cooking of a cooking product and/or of a cooking duration determined, in particular, by the core temperature, the browning, the pH value, and/or the cooking value from measured values of the sensor device, taking account of values stored at least temporarily in the memory device; and a cooking appliance for carrying out such a method.

BACKGROUND

It would be advantageous for many automatic cooking processes to determine and have at one's disposal a parameter allowing a statement about the progress of the cooking.

From DE 42 31 365 A1, a method is known for baking, roasting or cooking, in which the cooking chamber temperature is controlled to a temperature target value, whereby in multiple successive time intervals, a value of the current cooking chamber temperature, or a value that is linearly-dependent on this current temperature, is determined, and these values are summed. When the sum of the values reaches a predetermined sum target value dependent on the product at the target temperature, or the value that is linearly-dependent on it, a pre-determined heat exposure duration and the reciprocal of the length of a time interval, a signal is produced for terminating the roasting, baking or cooking operation. In this manner, temperature fluctuations in the cooking chamber, as they may occur for example during loading or other disturbing influences can be taken account of during a cooking operation. A disadvantage of this state of the art is that the actual temperature of the cooking product is not used for determination of the cooking, but that merely the cooking chamber temperature is assumed to be a variable corresponding to the cooking product temperature. As a result of this, erroneous evaluation regarding the endpoint of the cooking may occur, specifically for cooking products with large diameter.

EP 0 419 304 A2 discloses a method of cooking of cooking products wherein the pH value or also the core temperature of a cooking product is used for the determination of a pasteurization value (P-value). The cooking appliance should conduct the cooking process in such a way that at the end of the cooking process the desired P-value, that is, the desired degree of freedom from germs in the food, is accurately achieved. After subsequent cooling of the temperature of the cooking product to a value of slightly over 0° C., a food that has a long shelf life can be produced. The P-value is only very indirectly related to how well-cooked the food is.

Also from DE 199 45 021 A1 it is known that a cooking process can be conducted as a function of a pH value or as a function of the hygiene of a cooking product. Furthermore it is described there that the cooking process can also be conducted as a function of the core temperature of a cooking product.

DE 196 09 116 A1 discloses a cooking method in a cooking chamber that is ended when an actual core temperature in a cooking product reaches a target core temperature. When an endpoint of the cooking process is set, the cooking chamber temperature, the circulating flow in the cooking chamber and the humidity level in the cooking chamber are adjusted or altered in such a way that the target core temperature is reached at the predetermined end point in time.

U.S. Pat. No. 4,281,022 discloses a cooking method for the cooking of thin meat in a microwave, in which a degree of cooking of the meat is determined based on the humidity and temperature in the cooking chamber. For this purpose, from the temperature and the humidity in the cooking chamber as well as from the elapsed cooking time, a time tx is calculated that is necessary for reaching a thermal equilibrium. This time tx is used to interrupt the cooking process as soon as a desired degree of cooking is achieved. The relationship between the time tx and the degree of cooking for thin meat is described in U.S. Pat. No. 4,281,022. A disadvantage here is that with the method only a special cooking product can be cooked, and that the cooking product must be cooked from beginning to end until the desired degree of cooking is achieved. Interruption and finishing at a later point in time is not possible with the method.

The disadvantage in the cited state of the art is that hygiene or the P-value and the core temperature of the cooking product are suitable only to a limited extent to determine the how well-cooked a cooking product actually is. Thus, for example, it is generally known that potatoes, even when they have reached a core temperature of almost 100° C. in boiling water, have not yet reached the consistency desired for consumption. Namely, actually it is required that this temperature in the core of the potato pieces be maintained for approximately 3 to 5 minutes in order to make the potatoes ready for consumption. The chemical reactions in which the components of the food are converted in fact require besides temperature a certain time span at which the components of the food can be converted. Such a behavior can be described with the C-value (cooking value) similarly to the P-value. Such a cooking value is known in ecotrophology and can be calculated as follows:

$$C_{BT}^{UF} = \int_{St}^{t'} UF^{\frac{[T_i(t)-BT]}{10}} dt, \text{ wherein} \tag{1}$$

UF=conversion factor,

BT=reference temperature=100° C.,

T(t)=core temperature progression,

St=time at which the starting temperature was exceeded, dependent on the food and t'=current time.

A method in which such an integral is determined in the determination of the bacterial load of a food, that is, a P-value, is known from EP 1 317 643 B1. However, there again only the determination of a pasteurization value is disclosed.

A method is known from WO 2004/062372 A2 for the cooking in a cooking chamber of a cooking appliance with a control that has access to the time-dependent and not time-dependent measured data that correlate with the state of the cooking product or of the cooking appliance. The actual development of the cooking process is determined herein with the aid of measured data Z1 of the cooking product I to be cooked, up to a pre-determined time TM before the end of the cooking time TE. Herein the data Z1(TE) at the end of the cooking process TE can be predicted. Herein the core temperature, the browning, the crust formation and also the hygiene of the cooking product are intended to be used as cooking parameters.

Within the framework of a further development, it would be desirable to interrupt the cooking process upon reaching a value for the progress of the cooking set by the client (for example a C-value) and to conclude it at a later time point within the framework of a new cooking process. This would provide a cook in the cafeteria or catering operation with the advantage that a meal could be prepared almost completely at a time when there is no time pressure in the kitchen, and then at a later time point the rest of the cooking could be achieved within a very short period of time without the meal being overcooked.

From WO 01/58214 A1, a method is known for providing a predetermined final preparation of precooked meal portions. Herein using a machine-readable code applied on the packaging, a temperature and a time course are read for a final preparation process, and a final preparation appliance is adjusted correspondingly. The required profile in this case is dependent on the preparation parameters used during the pre-cooking. The final preparation parameters to be used can be determined empirically in preliminary experiments as a function of the pre-preparation state. A disadvantage here is that the client, that is, the cook in a large kitchen or in a catering operation, does not have the possibility of determining himself or herself to what degree the cooking product should be pre-cooked in the first step. Furthermore, the method does not allow to react to a change in the cooking process during pre-cooking in such a way that the final preparation will succeed in any case.

JP 63 128 969 discloses a cooking appliance in which, using a setting device, a start, an interruption and an end of the cooking process can be entered. With the aid of a program, a heating time can be determined at the beginning of a cooking process and a heating time can be determined for the case of reheating. A disadvantage here is that no percentage input can be entered by a client. Also no C-value can be used for the determination of the degree to which a food is cooked, since no core temperature sensor is provided in order to determine an internal cooking parameter in the food. It is not provided either that the food could be finish-cooked at a later time point based on an already-achieved degree of cooking, with the aid of a separate cooking process.

A process for conducting a cooking process in a cooking appliance of the above-mentioned type is known from WO 98/48679, in which, with the aid of the derivative of a cooking parameter with respect to time, the end of a cooking process can be pre-calculated in order to convert the cooking product at a defined time before the end of the cooking process with a subsequent part of the cooking process to an end state. A disadvantage here again is that the cooking process cannot be interrupted, and thus no final cooking process in which the cooking to completion of the cooking product takes place is provided that could be shifted to an arbitrary time point later. Also, input regarding the degree of cooking as a client wish is not provided for.

GENERAL DESCRIPTION OF THE INVENTION

One object of the present invention is consequently further to develop the process and cooking appliance of the type mentioned above, so that the disadvantages of the state of the art are overcome. Specifically, the input of a desired intermediate degree of cooking of a cooking product, an interruption of a cooking process upon reaching this intermediate degree of cooking and an automatically-calculated time-shifted continuation of the cooking process, where the rest of the cooking is achieved at a later time point, is made possible.

According to the invention, this object is achieved by at least two steps that are shifted in time from another, comprising a pre-cooking step which is interrupted upon reaching a certain intermediate value of the degree of cooking and/or the duration of cooking, in particular of a determined remaining time until reaching the cooking duration, and a finishing cooking step, in particular in the form of a finishing step that is recalled at a later time point, in order to end the cooking of the cooking product taking account of the intermediate value.

Hereby it can be provided that the degree of cooking is calculated by time summation or a time integral of at least one measured value, in particular a measured value determined by means of a core temperature sensor and/or at least one gas sensor, for determination of the chemical state of the cooking product based on the atmosphere in the cooking chamber.

It can also be provided that the intermediate value is determined in dependence on the duration of another cooking step, wherein the other cooking step preferably corresponds to the finishing cooking step.

It is preferred according to the invention that the intermediate value and/or an end value of the degree of cooking and/or the duration of cooking, in particular the duration of the finishing cooking step, can be altered and/or selected by means of an operating and/or display device, preferably at the beginning of the process and, in particular, with selection of a cooking product, a cooking program and/or at least one parameter of the cooking product and/or of the cooking program and/or of an at least partially predetermined finishing cooking step.

Herein again, it can be provided that the parameter of the cooking product characterizes the size, the caliber, the weight, the temperature, the initial state and/or the quality of the cooking product before cooking, and/or the parameter of the cooking program characterizes the humidity, the air circulation and/or the temperature in the cooking chamber and/or the target value of the browning of the cooking product, and/or the parameter of the finishing cooking step characterizes the humidity, the air circulation and/or the temperature in the cooking chamber.

Furthermore, it can be provided according to the invention that the intermediate value and/or the end value is determined and/or displayed on the operating and/or display device by the computer device, in particular with accessing of the values stored in the memory device, in dependence on the selected cooking product, the selected cooking program and/or the selected finishing cooking step.

Herein, it is proposed with the invention that the determined and/or displayed intermediate value and/or end value can be altered, preferably via the operating and/or display device, and/or can be stored, preferably in the memory device, in particular after a change.

Particularly preferred example embodiments of the invention are characterized in that the intermediate value is determined, selected, displayed and/or stored in the form of a percentage value relative to the end value.

Methods according to the invention can be characterized in that, in particular upon reaching the intermediate value in the pre-cooking step, at least the intermediate value is stored in the memory device, and in that, in the finishing cooking step, the cooking of the cooking product is ended taking account of at least the intermediate value retrieved from the memory device and measurement values recorded by the sensor device.

Furthermore, the method according to the invention can be characterized by storage in the memory device of measured values, the intermediate value, the end value, the cooking product, the cooking program and/or the parameters, preferably together with an identification, in particular one that can be selected and/or changed via the operating and/or display device.

Herein, it can be provided that the identification can be displayed, altered and/or stored, in particular together with the degree of cooking of the cooking product, preferably during the complete process.

With the invention, it is also proposed that the finishing cooking step can be selected via the identification and, in particular with the aid of the operating device and/or display device, as well as altered and/or stored.

Furthermore, according to the invention, it can be provided that the finishing cooking step can be started via the operating and/or display device.

Furthermore, it is proposed with the invention that at least one cooling and/or storage step is performed between the pre-cooking step and the finishing cooking step.

It is also preferred, according to the invention, that in the determination of the intermediate value, when conducting the pre-cooking step and, in particular in the determination of the end of the pre-cooking step, and/or when conducting the finishing cooking step and, in particular, in the determination of the end of the finishing cooking step, a continuation of the cooking after the end of the pre-cooking step and/or after the removal of the cooking product from the cooking chamber after the completion of the pre-cooking step is taken account of, optionally with consideration of the cooling and/or storage step, in the form of a correction term.

Hereby, it can be provided that the correction term be calculated in dependence on the development over time of the measured values of the sensor device at least during the pre-cooking step, in particular of a cooking product variable recognized during the pre-cooking step, preferably calculated by the caliber of the cooking product, the size of the cooking product and/or the weight of the cooking product, and/or of the time point of the removal of the cooking product from the cooking chamber after completion of the pre-cooking step and/or of the time point of introduction of the cooking product into the cooking chamber for the finishing cooking step, whereby the cooking product size and/or the cooking product caliber are especially calculated through the first and/or second derivative of the core temperature with respect to time.

Hereby it can be provided that the correction term be used for correcting the duration of the finishing cooking step, wherein the duration is displayed before and/or after the correction, in particular via the operating and/or display device.

With the invention it is also proposed that a client input via the operating and/or display device for the intermediate value be checked for plausibility, taking account of the selected cooking product, the selected cooking program and/or the at least one selected parameter, and/or taking account of the measured values captured by means of the sensor device.

Herein, it can be provided that in the case of a recognized lack of plausibility, a message is output, in particular via the operating and/or display device, and/or a calculated intermediate value is automatically displayed as a proposal, wherein the proposal can be changed and/or stored.

In a further embodiment of the invention, it is proposed that, during the pre-cooking step, a development over time be determined of at least one property that determines the climate in the cooking chamber, such as humidity, temperature and/or air circulation in the cooking chamber, for the finishing cooking step, wherein preferably with this development the cooking product reaches cooking duration within a predetermined duration specifically entered through the operating and/or display device, of the finishing step with the predetermined end value of the degree of cooking of the cooking product specifically entered through the operating and/or display device, and/or with the predetermined cooking duration entered through the operating and/or display device.

It is also proposed with the invention that a target time, especially a target clock time, be entered at which the finishing cooking step should be completed.

Herein, it can be provided that several pre-cooked cooking products, in particular products pre-cooked in different pre-cooking steps, can be cooked with the finishing cooking step to the desired end values of the degree of cooking and/or cooking duration, so that the end values of all cooking products are substantially reached at the target time.

Furthermore it is proposed that the target time, together with the cooking product, especially using the identification and/or the intermediate value, be entered and/or stored preferably for all pre-cooked cooking products.

Herein, it can be provided that a loading time point at which the cooking product is loaded into the cooking chamber is calculated preferably for each pre-cooked cooking product so that the end value of the degree of cooking is reached at the target time, whereby preferably at the loading time point an invitation to load the cooking product is displayed, in particular with display of the identification associated with it, on the operating and/or display device.

Herein, it is advantageous when, in the calculation of each loading time point, the caliber of the particular cooking product and/or the number of other cooking products to be loaded into the cooking chamber be taken account of.

It can be provided in accordance with the invention that the sequence of the pre-cooking steps and/or the starting time point of each pre-cooking steps and/or each loading time point is automatically calculated.

Herein, it can be provided that during the first pre-cooking step, the duration and/or the at least one property of the finishing cooking step that determines the climate be determined.

Herein, it can also be provided that the cooking products of the further pre-cooking steps be pre-cooked to the particular intermediate values, from which, the finishing cooking step with its determined duration or at the determined target time, preferably taking into consideration the climate parameter, cooks the cooking products to their respective end values.

An advantageous embodiment of the invention provides that a warning be given, in particular, a warning on the operating and/or display device, when the entered target time cannot be reached and/or a combination of different pre-cooked cooking products cannot yield satisfactory results in the finishing cooking step and, in particular, when the pre-cooked cooking products require different climate parameters.

Herein, it can be provided that with the warning, alternative possible target times, finishing cooking steps and/or pre-cooking steps are indicated, wherein preferably a selection of an alternative via the operating and/or display device is made possible.

Herein, furthermore, an advantage can be realized when during at least one pre-cooking step at least one subsequent loading time point and/or removal time point of at least one cooking product from the cooking chamber is determined via the anticipated duration of the pre-cooking step and/or via the property that determines the development over time of the climate in the cooking chamber, wherein preferably a request for loading and/or removal of the cooking product is displayed at each loading time point and/or removal time point, in particular with display of the associated identification on the operating and/or display device.

According to the invention, also a cooking appliance with a cooking chamber, a computer device, a memory device, at least one sensor device and at least one heating device are provided for performing the method according to the invention.

Herein an operating and/or display device, preferably comprising keys, a rotary knob and/or a touch screen can also be provided.

Thus, the invention is based on the surprising finding that the essentially continuous calculation of a degree of cooking during a cooking process, such as, for example of a core temperature or of a C-value with the aid of an inner cooking parameter, for example, the core temperature or the pH value, permits one to calculate a defined percentage of a pre-cooking and/or a remaining time for reaching the final cooking state in a later cooking process. Upon reaching the determined percentage, or the determined remaining time, which can be entered previously by a user or already preset, it is possible to interrupt the cooking process and to store the cooking product thus pre-cooked for a later final preparation, refrigerated under hygienic conditions. At a later time, then, the missing percentage of the degree of cooking, for example of the C-value, can be achieved with the aid of a separate finishing step in a short time, namely during the remaining time period. Thus it can be assured that a meal can be prepared within a short time at rush times in the kitchen operation without undercooking or overcooking the food. Herein a memory device can be provided, which stores the percentage value of the degree of cooking and/or the remaining time, together with other data, for example, desired end values entered by the user, the type of food or an identification entered by a user. Thus it can be ensured that a user can quickly and easily call up and start the suitable concluding cooking process for finishing the food.

A whole number of advantages arise from this for a user, especially in large and industrial kitchen operations such as in the cafeteria and catering area. Due to the fact that, for example, the percentage of a final cooking state to be reached (C-value or core temperature) can be entered, it is possible for a cook to allow his experience to influence the treatment of the food. Thus, he can allow his personal preferences to exert themselves and can determine himself that, for example, a vegetable is pre-cooked to a cooking degree of 95%, whereas meat is pre-cooked to a degree of cooking of 80%, and so that the vegetable and meat during the final cooking of 5% and 20% of the end value of the degree of cooking, respectively, receive the exactly correct consistency according to his opinion. It is also possible that a user himself determines how much time he has available for the final cooking of the pre-cooked food in such a cooking appliance. Thus, in a kitchen operation the flow in time can be coordinated substantially more precisely than before. During the so-called finishing or regeneration of foods, in addition, the user walking the tightrope between a reheating time that is as short as possible and the best possible cooking result is able to decide for himself as to where to draw the limit for which cooking product.

BRIEF DESCRIPTION OF THE DRAWINGS

Other characteristics and advantages of the invention follow from the description given below of a practical example with reference to the attached schematic drawings. The following are shown.

DETAILED DESCRIPTION OF THE PREFERRED EMBODIMENTS

Figure 1:
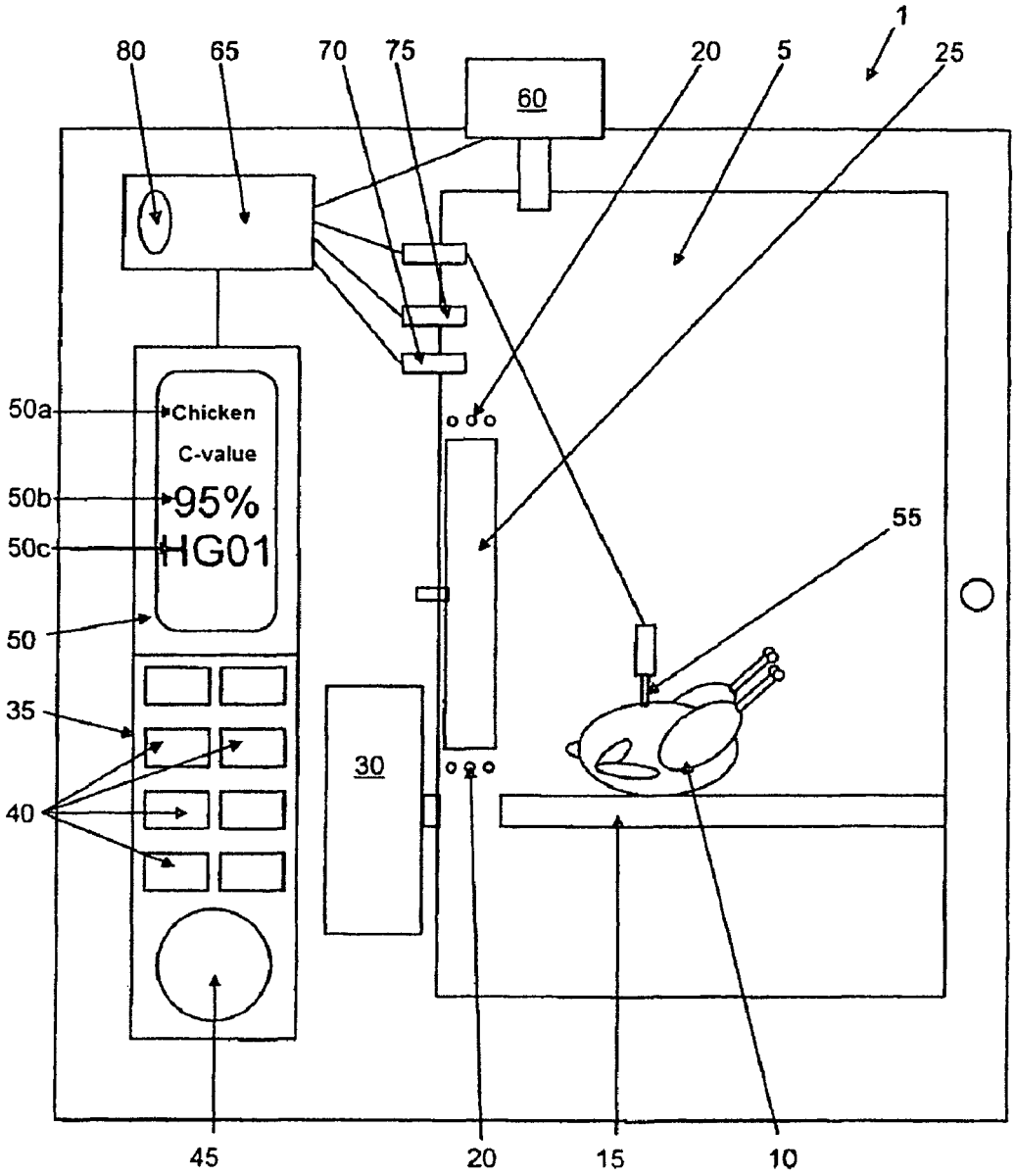
FIG. 1 shows a cooking appliance according to the invention.

FIG. 1 shows a cooking appliance 1 according to the invention, with a cooking chamber 5 in which a cooking product 10 can be placed on a cooking product carrier 15. A heater 20 and a fan wheel 25 are arranged around the cooking chamber 5 for heating. Furthermore, a vapour generator 30 is provided for feeding vapour into the cooking chamber 5.

A user can select a cooking program 50*a* via an operating device 35 that has one or several keys 40 and a rotary knob 45, with the aid of a display device 50. Subsequently, the user can enter via the operating device 35 various target entries, such as browning and core temperature for the selected cooking program, or change pre-sets for these. Then an option appears on the display device 50 for performing a cooking process according to the invention, for example, in the form of a field "cooking with finishing" or "cooking for finishing," which can be selected by pressing the field on the display device 50, which is in the form of a touch screen. If this option is selected by the user through the operating device 35 or through the display device 50 that is designed as a touch screen, then the selected cooking program with the desired parameters is converted into a cooking program according to the invention, that is, into a cooking program that can be interrupted. For this purpose, the user must enter an intermediate value for the degree of cooking, for example, in the form of a C-value or a core temperature, or a finishing time via the operating device 35, for example, with the aid of the rotary knob 45. The selected values 50*b* are displayed on the display device 50.

As soon as a cooking product 10 has been introduced into the cooking chamber 5, an identification 50*c* appears on the display device 50, which can be changed by the user via the operating device 35. During the precooking step that now begins, the state of the cooking product 10 is monitored with the aid of a core temperature sensor 55 that was inserted into the cooking product 10 and/or monitored with the aid of a gas sensor 60. With the aid of the computer device 65, the cooking appliance 1 controls the climate in the cooking chamber 5 via the heater 20, the fan wheel 25, and the vapour generator 30. For this purpose, the cooking chamber temperature is monitored with the aid of a cooking chamber temperature sensor 70 and the humidity with the aid of a moisture sensor 75.

From the progress of the measurement data of the core temperature sensor 55 and/or of the gas sensor 60, the computer device 65 calculates the current degree of cooking of the cooking product 10 during the pre-cooking step. Conclusions can be made regarding the time point of the anticipated end of the cooking program from the time development of the degree of the cooking. The residual cooking time and/or the actual degree of cooking 50*b* which follow from the anticipated end and from the current cooking time can be displayed on the display device 50 during the pre-cooking step, for example, at the place where previously during the input of the intermediate value and the end value of the degree of cooking by the user the entered values were displayed on the display device 50. Upon reaching the degree of cooking entered by the user or when the calculated remaining time of the cooking program agrees with the finishing time entered by the user, the end of the pre-cooking step is reached. At this time the user is invited with the aid of the display device 50 to remove the cooking product 10 from the cooking chamber 5. In addition, it is conceivable that an acoustic signal draws the attention of the user to the end of the pre-cooking step.

As soon as the door (not shown) to the cooking chamber 5 is opened, the computing device 65 stores in a memory device 80 the actual degree of cooking of the cooking product 10 together with the identification 50*c* entered by the user or predetermined. The user also has the possibility at this time point of changing the identification 50*c* using the operating device 35. The identification 50*c* represents a kind of load designation which can serve for unequivocal assignment of the information about the state of the cooking product 10, for example, degree of cooking, C-value, core temperature reached, the selected cooking program, the nature of the cooking product and the size of the cooking product at the end of the pre-cooking step of each cooking product load. At a later point in time the cooking product load can be identified with the aid of identification 50*c*, so that the state of the cooking product 10 at the end of the pre-cooking step can be read from the memory device 80.

Subsequently, the user can continue to use the cooking appliance 1 as usual, and can also start other cooking programs 50*a* according to the invention. In the meantime still other intermediate values 50*b* for degrees of cooking together with other identifications 50*c* can be stored in the cooking appliance 1.

Usually the already pre-cooked cooking products 10 are brought into an external cooling device, for example a shock cooler, which is not shown, after they have been removed from the cooking chamber 5, in order subsequently to store them in a cooled state until a finishing step. A finishing step is a finishing cooking step, that is, a program step in which a pre-cooked cooking product 10 is cooked so that it is ready to consume. Hereby it may occur that after-cooking of the cooking product 10 occurs in the shock cooler due to the heat stored in the cooking product 10. From the time development of the values measured by the core temperature sensor 55 and/or by the gas sensor 60, one can draw conclusions regarding the size, that is, the diameter, and the heat conducting properties of the cooking product 10. The larger the cooking product 10 the stronger will be the after-cooking after removal from the cooking chamber 5. This information can be used to calculate a correction term which is automatically added to the stored degree of cooking or deducted from the remaining time. Thus, this correction term also influences the time point of the end of the pre-cooking step where a finishing time was entered by the user. In case of entry of an intermediate value for the degree of cooking by the user, the after-cooking can be taken account of in the subsequent finishing step by means of the correction term. However, it is also easily possible, on entry of an intermediate value for the degree of cooking, already to use the correction term for shortening the pre-cooking step.

The correction term can be calculated like the C-value itself. At the time point of removing the cooking product 10 from the cooking appliance 1 after the pre-cooking step, the size of the cooking product, the nature of the cooking product and the temperature inside the cooking product are known. Starting from this time point, the cooking product 10 is cooled and therefore the heat will flow from the inside of the cooking product 10 toward the outside. Thus a decay curve is obtained for the core temperature that depends on the size of the cooking product 10 and on its thermal conductivity. For the thermal conductivity of the cooking product 10, a value can be assumed that depends on the nature of the cooking product 10. The decay function T(t) determined in this way is integrated with the aid of equation (1), and thus the correction term is determined,.

Moreover, specifically in the case of large cooking products, heat is stored in the areas of the cooking product 10 that lie between the core and the surface. This temperature gradient inside the cooking product 10 is dependent on its size, thermal conductivity and the time that the cooking product 10 spent in the warm or hot cooking chamber (5). Due to the energy stored in this region, the core temperature will increase until the cooling penetrates from the outside, and leads to a decay of the core temperature. This part of the core temperature change T(t) can also be taken account of with Equation (1) and thus enter into the correction term.

However, both correction terms can also be estimated by simple numerical values that were obtained previously in laboratory experiments for defined types of cooking products, sizes of cooking products and temperature courses inside the cooking products. These numerical values are stored in the memory device 80 of the cooking appliance 1.

At a later point in time the user removes a previously cooked cooking product 10 cooked in a pre-cooking step from the cooling device, in order to bring it into the final state, in which the cooking product 10 is ready to be consumed, with the aid of the cooking appliance 1. For this purpose, the user can first select via the operating device 35 the correct finishing step for his/her cooking product 10 from a list with stored identifications 50*c*. When the user has chosen via the operating device 35 a certain identification 50*c*, the computer device 65 loads from the memory device 80 the associated degree of cooking already reached and corrected with the correction term, together with the cooking program that is applicable to the cooking product 10 and also the desired parameters already entered by the client in the pre-cooking step. With the aid of the entered parameters and the stored degree of cooking, the course of the finishing step can be controlled in such a way that the missing part of the degree of cooking will be applied to the cooking product 10. If a finishing time was already preset by the user, then based on the fact that the cooking program was interrupted at the correct point in time at the end of the pre-cooking step, it is possible to cook the cooking product 10 within the predetermined time to the desired end value of the degree of cooking.

In case a finishing time was entered by a user, the time must be taken into consideration that is required for heating the cooking product 10 all the way to the inside in the finishing step. If the input of the finishing time was chosen by the user to be so short that due to the size of the cooking product 10 determined by the computer device 65 with the aid of sensors 55, 60, 70, 75, sufficient time for reheating the cooking product 10 in the finishing step is not possible, it is conceivable that the user can be advised of this problem via the display device 50 and a minimum finishing time for this particular cooking product 10 proposed. Ideally this is already done towards the end or at the end of the pre-cooking step.

Figure 2:
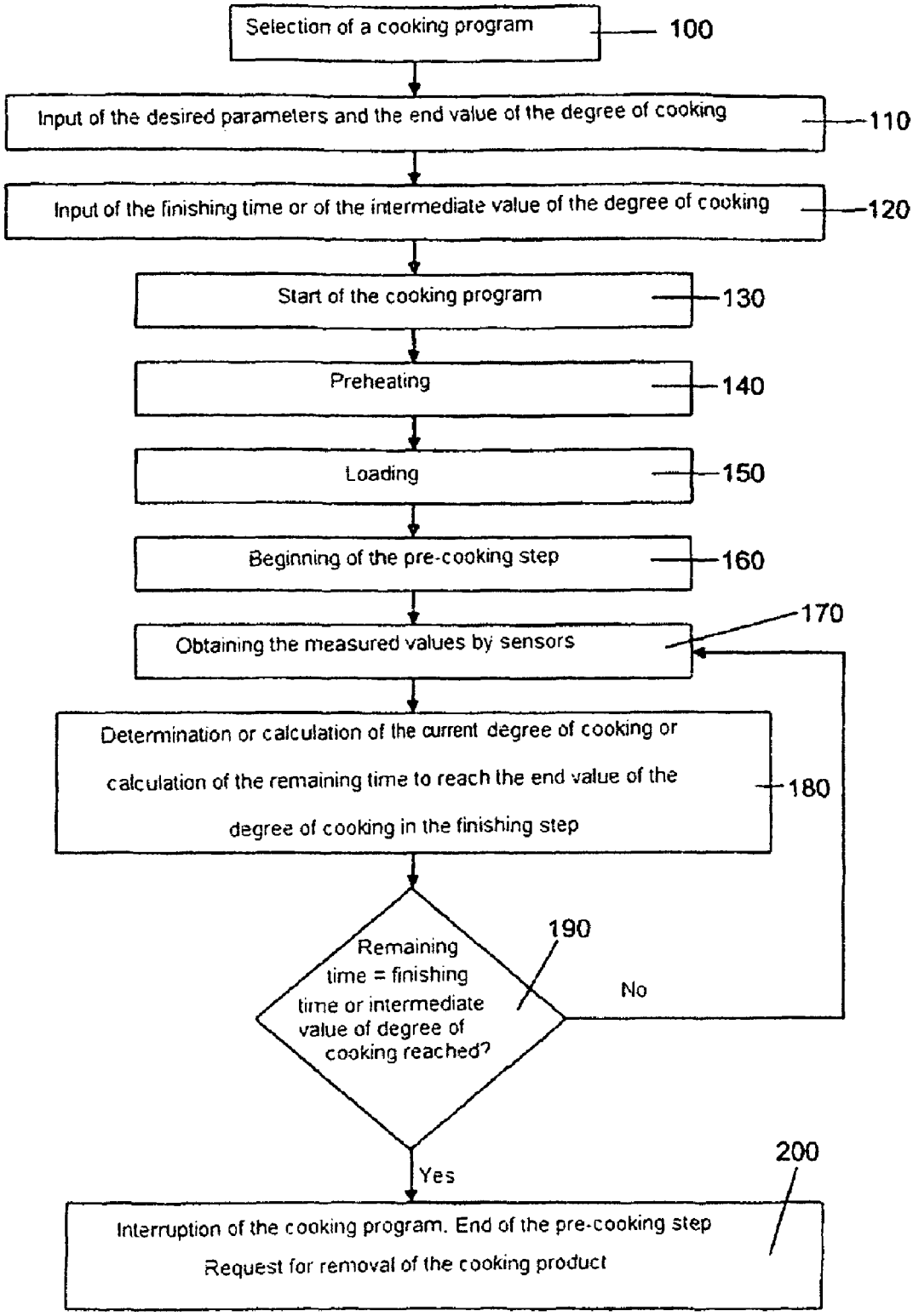
FIG. 2 shows the progress of a part of a process according to the invention.

FIG. 2 shows the typical course of the selection of the cooking program 50*a* with desired parameters and a pre-cooking step according to the invention. First a cooking program 50*a* is selected by a user (step 100). Then various desired parameters and the end value of the degree of cooking can be entered (step 110). This includes specifically the core temperature, the browning or very general inputs, such as, for example, rare, medium and well done. In the next step 120, the user can enter a finishing time or an intermediate value of the degree of cooking 50*b*. An input regarding climate, for example temperature, humidity and/or air velocity in the cooking chamber (5) during the finishing step, which influences the course of the finishing step, can also be possible. Advantageously, already preset parameters, which can be changed by the user, are displayed for this. The cooking program 50*a* is started in the next step 130.

In the following step 140, the cooking chamber 5 is preheated to a suitable temperature and the vapour generator 30 is optionally also put into a state of operational readiness. The preheating can also already be started after selection of the cooking program 50*a* and carried out parallel to the inputs of the user. Once the preheating of the cooking chamber and of the vapour generator 30 are concluded, then, in the next step 150, an invitation to load the cooking chamber 5 follows. As soon as the cooking chamber 5 is loaded with cooking product 10, which can be determined by the opening and closing of the door of the cooking chamber, for example, via a contact switch, the actual precooking step 160 begins. During the preloading, if necessary, the core temperature sensor 55 must be inserted into the cooking product 10. During the precooking step 170, the measured values are recorded by the sensors 55, 60. Sensors 70, 75 also yield measured values, which are stored in the memory device 80 of the computer device 65 together with the time points of the measurements. From the sensor data in the next step 180, during the preheating step, the actual degree of cooking of the cooking product 10 is determined or calculated and/or the remaining time for reaching the end value of the degree of cooking in the finishing step is calculated. Simultaneously, the computer device 65 of the cooking appliance 1 calculates the size of the cooking product 10 from the measured values of sensors 55, 60, 70, 75. The size of the cooking product 10 has an influence on the correction term with which the after-cooking of the cooking product 10 after removal from the cooking chamber 5 is taken account of, and on the time that is necessary for heating the cooking product 10 in the subsequent finishing step to the necessary consumption temperature. These parameters also influence the course of the finishing step and thus also mathematically the remaining time and/or the intermediate value of the degree of cooking to be reached. In a next step 190, the current calculated remaining time is compared with the finishing time entered by the user, respectively the intermediate value entered by the user is compared with the current degree of cooking. If the remaining time thus calculated is shorter than the finishing time entered by the user or if the intermediate value of the degree of cooking has not yet been reached, then the pre-cooking step is continued further, that is, additional measured values are determined by the sensors 55, 60, 70, 75, that is, one returns to step 170.

This cycle is repeated until the remaining time has reached the finishing time entered by the user, or the intermediate value entered by the user for the degree of cooking is reached. When this is the case, the end of the pre-cooking step is reached and the user is invited to remove the cooking product 10 (step 200). Ideally, the degree of cooking continues to be calculated further until the opening of the door of the cooking chamber, in order to take into consideration a delay of the removal by the user. Subsequently, the user can store the parameters thus stored (client inputs current degree of cooking, size of cooking product 10, cooking program 50*a* used, etc.) together with an identification 50*c*, which can be modified by the user, in the memory device 80.

At a later point in time (not shown in FIG. 2) these parameters can be recalled again with the aid of the identification 50*c*, and thus a suitable finishing step can be calculated and performed for the pre-cooked cooking product 10.

If the preset parameters for a pre-cooking step appropriate to a standard finishing step have been confirmed without change, then the cooking products to be cooked are all cooked in such a way that all are cooking to completion with the same parameters, that is finishing time, temperature, humidity and air stream during the standard finishing step. Then, all pre-cooked foods can be prepared, ready for consumption, with one and the same finishing program.

Herein more than one standard finishing step can also be selected. With the aid of the operating device 35, various standard finishing steps can be selected, which are displayed on the display device 50 and the parameters of which are stored in the memory device 80. For example, pre-cooking steps for standard finishing steps "short", "medium" or "long", which indicate a measure of the finishing time, or "moist", "medium", "dry", which is a measure of the climate during the finishing step, or "small", "medium", "large", which is a measure of the size of the cooking product to be treated, are possible. Combinations of these are also possible.

If such a pre-cooking step with a standard finishing step is selected, the pre-cooking step runs according to the prescriptions that follow from this. All such pre-cooked cooking products then can be cooked to completion with a standard finishing step. The selection of a standard finishing program then corresponds to an identification 50*c* of the pre-cooked cooking product 10, wherein a whole number of pre-cooked cooking products are characterized by such an identification 50*c*. Specific information for a special cooking product can no longer be used for starting the corresponding standard finishing step. The information that was obtained with the aid of the selected standard finishing step, that is, of the pre-cooking step, can nevertheless be utilized for the standard finishing step or finishing cooking step. Thus, the intermediate values for the degree of cooking, that is, the C-values according to Equation (1), for all cooking products that were cooked with the same pre-cooking step for the same finishing cooking step, are depending on the size and nature of the cooking product, so high, that in the standard finishing step all cooking products designated by this identification 50*c* reach the selected target prescriptions on performance of the standard finishing step.

It is also possible that a user prescribes that a whole series of cooking products pre-cooked in pre-cooking steps should be cooked to completion at a specific time. For this purpose, the user can recall various cooking product classes or stored identifications 50*c* via the operating device 35 in the cooking appliance 1 and select a single finishing step with which all cooking products can be cooked to completion at a time set by him/her. In this way it can be achieved that an entire menu is cooked to completion at the same time at the point in time desired by the user. In order to make this possible, how much time is needed for the cooking processes loaded from the memory device 80 is calculated in the computer device 65. The cooking process that will require the longest time is displayed first. Via the display device 50, the user of such a finishing step is requested to load the first cooking product, which requires the longest time, into the cooking appliance. The duration of the finishing step calculated during the pre-cooking step makes it possible to choose the point in time in such a way that the first cooking product will be cooked to completion at the point in time desired by the user.

The cooking appliance 1 can already preheat and/or prepare the cooking chamber 5 with the aid of heater 20 and steam generator 30 so that the cooking appliance 1 is in a climatic state at the time of the loading request that is suitable for the first cooking product. As soon as the time difference between the current time and the time determined by the user corresponds to the time duration that a cooking product 10 selected by the user with the aid of identification 50*c* needs, the user will be requested to load the cooking chamber 5 with the second cooking product. This will be continued for the remaining cooking products until all cooking products are cooked ready for consumption with the combined finishing-cooking step. At the time set by the user all the cooking products selected by him will then be ready.

The identification routines that run during the pre-cooking step can naturally be used for setting the duration of the finishing cooking step and/or for the calculation of the intermediate value to be reached in the pre-cooking step. Herein load recognitions and caliber identifications in particular are useful, in which the total mass of the cooking product located in the cooking chamber, or the size, or the mean diameter of the cooking product is determined. For such identifications, usually the developments over time of the signals of cooking chamber temperature sensors, core temperature sensors or gas sensors are used. However, it is equally possible to draw conclusions regarding the size of the cooking products and the number of cooking products with the aid of optical sensors or ultrasound sensors. As already explained, such information can be useful for the determination of the duration of the finishing cooking step and of the intermediate value to be reached in the pre-cooking step. However, the time behavior in the form of the first and second division of the signal according to time can also be used herein.

During the pre-cooking step, a climate suitable for the finishing cooking step with which a cooking product should be treated in the finishing cooking step can also be determined. The climate is determined by the temperature, humidity and the air velocity in the cooking chamber. The ideal climate during the finishing cooking step depends significantly on the cooking product 10 to be cooked and thus it is mostly determined by the client input, which, ideally, was stored together with the identification 50*c*. In a combination finishing cooking step in which several cooking products are cooked to completion simultaneously, however, it may occur that a very special climate is especially suitable for a mixture of the different cooking products.

In order to make such a combination finishing cooking step possible, it can also be possible with the method and cooking appliance according to the invention already to enter in the pre-cooking step a combination of different cooking products and corresponding cooking processes that should, at a time determined by the user, be brought into the final state desired by the user in a combination finishing cooking step. The cooking appliance can then calculate the ideal climate for the mixed load in the combination finishing cooking step and inform the user at what time point which pre-cooking steps must be performed. It is expedient first to carry out those pre-cooking steps of which the duration is difficult to estimate, since they depend significantly on the size of the cooking product. Thus, for example, it would be expedient first to start a cooking program for a large roast, because the duration of the corresponding cooking program is the most uncertain. Moreover, especially in the case of large calibers of large roasts, the finishing cooking step for such a large roast could last longer than the finishing cooking step of the trimmings and the vegetables. Thus, after the completion of the pre-cooking step for the large roast, one can estimate at what time the cooking appliance is needed again in order to start the combination finishing cooking step at the time at which reaching the final state of cooking at the time point given by the user is possible.

If it is found in the calculation of the duration of the remaining time of a pre-cooking step that not all selected pre-cooking steps can be concluded at the right time in order to make it possible to start the combination finishing step at the correct time, then this can be announced to the user via the display device 50. Then the user can either delete certain selected cooking processes, shift the desired time at which the combination finishing cooking step is to be concluded to a later time, or select a combination pre-cooking step with which two different cooking products can be cooked to completion in a single pre-cooking step until reaching the intermediate value. For this purpose, the ideal time points are selected at which the various cooking products should be introduced into the cooking chamber 5 and again removed from it during the combination pre-cooking step. Herein, in addition to the expected duration of the cooking steps of the different cooking products, specifically also the ideal climate for the cooking products is decisive. Naturally, certain combinations are impossible to realize in a single cooking step. This too must be taken into consideration in setting up the combination pre-cooking steps and combination finishing cooking steps.

If such an impossible combination is entered by the user, then he will be informed via the display device 50 about the possible risks when performing such a process or the desired cooking process will not be started with a corresponding reference. Expediently, an alternative proposal can be provided to the user with which a possible cooking procedure for the cooking processes selected by the user is proposed. Here, for example, a separation of a combination finishing cooking step into two or more different finishing cooking steps or combination finishing cooking steps can be considered in which the various cooking products are cooked to completion, for example, in the climate suitable for them (for example dry and moist).

The features disclosed in the above specification and in the claims can be essential both individually as well as in any arbitrary combination for the realization of the invention in its various embodiments.

What is claimed:

1. A method of cooking a cooking product in a cooking appliance including a cooking chamber, at least one heating device, a computer device, a memory device, and at least one sensor device, the method conducted by the computer device in dependence on at least one of a degree of cooking of a cooking product and a cooking duration, wherein the at least one of the degree of cooking of the cooking product and the cooking duration is determined from measured values of the at least one sensor device in particular by at least one of a core temperature, a browning, a pH value, and a cooking value, taking into account values stored at least temporarily in the memory device, the method comprising:

performing a pre-cooking step, which is interrupted upon reaching a certain intermediate value of the at least one of the degree of cooking and the duration of cooking; and performing a finishing cooking step taking the intermediate value into account, wherein the finishing cooking step is separated in time from the pre-cooking step by being recalled at a time point later than performing the pre-cooking step in order to end the cooking of the cooking product.

2. The method of claim 1, comprising interrupting the pre-cooking step upon reaching a determined remaining time until reaching the cooking duration.

3. The method of claim 1, further comprising calculating the degree of cooking of the cooking product by performing at least one of (a) time summation and (b) a time integral of at least one of the measured values.

4. The method of claim 3, comprising determining at least one of the measured values by means of at least one of (a) a core temperature sensor, and (b) a gas sensor for the determination of the chemical state of the cooking product based on the atmosphere in the cooking chamber.

5. The method of claim 1, further comprising determining the intermediate value in dependence on the duration of a further cooking step.

6. The method of claim 5, comprising determining the intermediate value in dependence on the duration of the finishing cooking step.

7. The method of claim 1, further comprising at least one of altering, selecting, and storing at least one of (a) the intermediate value, (b) an end value of the degree of cooking, and (c) an end value of the cooking duration, by means of at least one of an operating device, a display device, and the memory device.

8. The method of claim 7, wherein at least one of altering and selecting an end value of the cooking duration comprises at least one of altering and selecting a duration of the finishing cooking step.

9. The method of claim 7, wherein at least one of altering and selecting an end value of the cooking duration comprises at least one of altering and selecting a duration of the finishing cooking step at the beginning of the method.

10. The method of claim 9, wherein at least one of altering and selecting an end value of the cooking duration occurs with a selection of at least one of:

(a) the cooking product, (b) a cooking program, (c) at least one parameter of at least one of (i) the cooking product, and (ii) the cooking program, and (d) an at least partially predetermined finishing cooking step.

11. The method of claim 10, wherein the parameter of the cooking product characterizes at least one of a size of the cooking product before cooking, a caliber of the cooking product before cooking, a weight of the cooking product before cooking, a temperature of the cooking product before cooking, an initial state of the cooking product before cooking, and a quality of the cooking product before cooking, the parameter of the cooking program characterizes at least one of a humidity in the cooking chamber, an air circulation in the cooking chamber, a temperature in the cooking chamber, and a target value of the browning of the cooking product, and the parameter of the finishing cooking step characterizes at least one of the humidity in the cooking chamber, the air circulation in the cooking chamber, and the temperature in the cooking chamber.

12. The method of claim 7, further comprising at least one of determining and displaying the intermediate value and the end value on at least one of the operating device and the display device by the computer device in dependence on at least one of the selected cooking product, the selected cooking program, and the selected finishing cooking step.

13. The method of claim 12, wherein at least one of determining and displaying the intermediate value and the end value comprises accessing the values stored in the memory device.

14. The method of claim 7, further comprising at least one of determining, selecting, displaying, and storing the intermediate value in the form of a percentage value relative to the end value.

15. The method of claim 7, comprising storing at least the intermediate value in the memory device upon reaching the intermediate value.

16. The method of claim 7, further comprising storing at least one of the measured values, the intermediate value, the end value, the cooking product, the cooking program, and the parameter in the memory device together with an identification.

17. The method of claim 16, further comprising at least one of selecting, altering, and storing one of (a) the identification and (b) the identification together with the degree of cooking of the cooking product.

18. The method of claim 16, further comprising at least one of selecting, changing, and storing the finishing cooking step via the identification.

19. The method of claim 1, further comprising performing at least one of a cooling step and a storage step between the pre-cooking step and the finishing cooking step.

20. The method of claim 1, further comprising:

determining a correction term reflective of at least one of (a) a continuation of the cooking after the end of the pre-cooking step and (b) a continuation of the cooking after removal of the cooking product from the cooking chamber after the completion of the pre-cooking step.

21. The method of claim 20, comprising taking the correction term into account when determining at least one of an end of the pre-cooking step, an end of the finishing cooking step, and a duration of the finishing cooking step based on the correction term.

22. The method of claim 20, wherein determining the correction term comprises considering at least one of the cooling step and the storage step.

23. The method of claim 20, wherein determining the correction term comprises calculating the correction term in dependence on the development over time of the measured values from the sensor device at least during the pre-cooking step.

24. The method of claim 23, wherein determining the correction term comprises calculating the correction term in dependence on a cooking product variable recognized during the pre-cooking step.

25. The method of claim 24, comprising determining the cooking product variable based on at least one of:

a cooking product caliber, a cooking product size, a cooking product weight, a time of removal of the cooking product from the cooking chamber after completion of the pre-cooking step, and a time point of introduction of the cooking product into the cooking chamber for the finishing cooking step.

26. The method of claim 25, further comprising determining at least one of the cooking product size and the cooking product caliber via a first and second derivative of a core temperature with respect to time.

27. The method of claim 21, further comprising displaying at least one of the duration of the finishing cooking step before correction and the duration of the finishing cooking step after correction via at least one of the operating device and the display device.

28. The method of claim 1, further comprising testing a client input for the intermediate value for plausibility, the input being received through the at least one of the operating device and the display device.

29. The method of claim 28, wherein testing the client input comprises taking into account at least one of the selected cooking product, the selected cooking program, the at least one selected parameter, and the measured values captured by means of the sensor device.

30. The method of claim 29, wherein, in the case of a recognized lack of plausibility, the method further comprises at least one of:

outputting a message, and automatically displaying a calculated intermediate value as a proposal, wherein the proposal can be at least one of changed and stored.

31. The method of claim 1, further comprising, during the pre-cooking step, determining a development of at least one property over time that determines the climate in the cooking chamber for the finishing cooking step.

32. The method of claim 31, wherein the at least one property comprises a property selected from the group consisting of humidity in the cooking chamber, temperature in the cooking chamber, and air circulation in the cooking chamber.

33. The method of claim 1, further comprising achieving at least one of (a) a predetermined end value of the degree of cooking of the cooking product and (b) the cooking duration, within at least one of (1) a predetermined duration of the finishing cooking step and (b) a duration entered through the at least one of the operating device and the display device.

34. The method of claim 1, further comprising entering a target time at which the finishing cooking step should be completed.

35. The method of claim 34, further comprising cooking several cooking products with the finishing cooking step to particular desired end values of the at least one of the degree of cooking and the cooking duration in such a way that the end values of all cooking products are essentially reached at the target time.

36. The method of claim 35, comprising cooking several cooking products that were pre-cooked in different pre-cooking steps.

37. The method of claim 35, further comprising at least one of entering and storing the target time, together with at least one of (a) the cooking product and (b) the cooking product for each of the several pre-cooked cooking products.

38. The method of claim 37, comprising entering and storing the target time using at least one of the identification and the intermediate value.

39. The method of claim 36, further comprising calculating a loading time point for each of the several pre-cooked cooking products at which the cooking product is loaded into the cooking chamber in such a way that the end value of the degree of cooking is reached at the target time.

40. The method of claim 39, further comprising displaying, on the at least one of the operating device and the display device, an invitation to load the cooking product at the loading time point.

41. The method of claim 40, wherein displaying comprises displaying the associated identification.

42. The method of claim 39, wherein calculating each loading time point comprises taking into account at least one of a caliber of the particular cooking product and the number of other cooking products to be loaded into the cooking chamber.

43. The method of claim 39, further comprising automatically calculating a sequence of at least one of the pre-cooking steps, a starting time points of each pre-cooking step, and each loading time point.

44. The method of claim 43, further comprising, during a first pre-cooking step, determining at least one of the duration of the finishing cooking step and the at least one parameter of the finishing cooking step.

45. The method of claim 34, further comprising issuing a warning when at least one of the following occurs: (a) the entered target time cannot be reached, (b) when a combination of the different pre-cooked cooking products cannot yield satisfactory results in the finishing cooking step, and (c) when the pre-cooked cooking products require different climate parameters.

46. The method of claim 45, further comprising, with the issuance of the warning, displaying at least one of alternative possible target times, finishing cooking steps, pre-cooking steps, and enabling a selection of an alternative via the at least one of the operating device and the display device.

47. The method of claim 46, further comprising, during at least one pre-cooking step, determining at least one of a subsequent loading time point and a removal time point of at least one cooking product from the cooking chamber via at least one of the anticipated duration of the pre-cooking step and the property that determines development over time of the climate in the cooking chamber.

48. The method of claim 47, further comprising displaying a request for at least one of loading and removing the cooking product at at least one of each loading time point and each removal time point.

49. The method of claim 48, comprising displaying the request with the display of the associated identification, on the at least one of the operating device and the display device.

* * * * *